US006345921B1

(12) United States Patent
Cheung

(10) Patent No.: US 6,345,921 B1
(45) Date of Patent: Feb. 12, 2002

(54) SHEET FEEDING APPARATUS EMPLOYING AIR STREAMS AS HANDLING MEDIA

(75) Inventor: Nigel M. Cheung, Ft. Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/733,599

(22) Filed: Dec. 8, 2000

(51) Int. Cl.[7] ..... B41J 11/58; B65H 1/08; B65H 1/10

(52) U.S. Cl. ..... 400/627; 271/147; 271/160; 271/30.1; 271/241; 271/243

(58) Field of Search ..... 400/624; 271/145, 271/243, 147, 160, 30.1, 126, 128

(56) References Cited

U.S. PATENT DOCUMENTS

| | | | | | |
|---|---|---|---|---|---|
| 3,871,641 | A | * | 3/1975 | Marx et al. | 271/42 |
| 4,579,330 | A | | 4/1986 | Lehmann | 271/11 |
| 4,768,769 | A | | 9/1988 | Roller | 271/11 |
| 4,919,413 | A | * | 4/1990 | Hannon | 271/133 |
| 5,008,713 | A | * | 4/1991 | Ozawa et al. | 355/319 |
| 5,813,826 | A | * | 9/1998 | Martin et al. | 414/797 |
| 5,982,510 | A | * | 11/1999 | Funahashi | 358/468 |

* cited by examiner

*Primary Examiner*—John S. Hilten
*Assistant Examiner*—Marvin P Crenshaw

(57) ABSTRACT

Sheets of paper, photos, transparencies and the like can be fed to a work station (scanner, printer, photocopies, etc.) from a staircased stack of said sheets by use of an air knife and wind tunnel system.

20 Claims, 7 Drawing Sheets

11
23
23'
70
74
76
76'
78
80
96
96'
100
100'
106
106'
110
112
114
15
18
26
32
116
118
120
122
123
124
12
13
14

SHEET FEEDING APPARATUS EMPLOYING AIR STREAMS AS HANDLING MEDIA

BACKGROUND OF THE INVENTION

Field of the Invention

The present invention generally relates to devices for conveying lightweight sheet stock items (such as sheets of paper, photos, transparencies, etc.) in a sheet handling path by means of streams or blasts of air. More particularly, this invention relates to devices for individually withdrawing such sheets from a stack, conveying them to a work station (scanner, photocopier, printing device and the like), removing said sheets from that work station and depositing them at some other location in the sheet handling path (e.g., at a sheet collection tray).

Some prior art sheet handling machines have employed blowers to produce air streams, positive air jets and negative vacuum streams that, in some way, handle sheet stock materials. For example, U.S. Pat. No. 4,768,769 teaches a paper feeding apparatus having a paper support tray, a rear vacuum plenum chamber (that acquires and physically contacts with the rear portion of a sheet of paper that is part of a vertical stack of said paper) and a front vacuum plenum chamber that is positioned over the front of the top sheet of that stack. The front vacuum is especially adapted to acquire and physically contact with the front portion of such a sheet. A sheet transport device is associated with the front vacuum plenum in order to transport a sheet that has been separated from the top of the stack and move it in a forward direction.

This sheet handling machine also employs an air knife positioned at the rear of the vertical stack. The air knife injects air between the trailing edge of the top sheet of paper in the vertical stack and the remainder of that stack. Again, after the sheet is separated from the stack by the air knife, it is acquired by, and physically contacted with, the front vacuum plenum and then transported in a forward direction. As the trailing edge of the removed sheet clears the vacuum, the next sheet in the vertical stack is, likewise, pried from the stack by the air knife. The air knife includes preacquisition fluffer jets that initially loosen the top few sheets in the stack. The device also employs lateral converging air streams to facilitate separation of the uppermost sheet from the stack.

U.S. Pat. No. 4,579,330 teaches a pneumatic sheet feeder for removing individual sheets (such as sheets of paper) from a vertical stack. A pair of parallel guide rails are provided so that the vertical stack is confined between the guide rails. This assures movement in a defined direction. Air blast nozzles are provided in the guide rails for blowing air streams against the stack to form an air cushion between the lowest sheet in the stack and the sheets above it. Radial openings in a suction chamber cause suction induced adhesion of the leading edge of the lowermost sheet with a vacuum producing cylinder so that, upon rotation of said cylinder, the lowermost sheet is carried away from the bottom of the stack.

Many air stream employing sheet feeder devices are, however, inclined to suffer from misfeeds wherein two or more sheets are withdrawn from a vertical stack from which only one sheet should be withdrawn for individual delivery to a work station. Such two or more misfed sheets can be fully registered or partially registered with each other as they are withdrawn from the stack. Such misfeeds are annoying, mistake producing, expensive and sometimes even destructive to certain sensitive, high speed equipment such as printers, scanners, photocopiers, etc.

Hence, applicant's invention is especially concerned with separating a top sheet (e.g., of paper) from a stack with less chance of misfeeds of the type just noted. In order to do this, the sheet feeding apparatus of this patent disclosure uses a sheet stepping device that places said sheets in a staircase-like configuration and then uses air nozzles to separate a top sheet from the staircase stacked sheets. An air stream created by such nozzles also establishes an air cushion between the top sheet and the other sheets. This air stream conveys the top sheet to a work station. In some of the more preferred embodiments of this invention, the same air stream used to separate the top sheet from the remainder of the stack is used to convey said sheet towards the work station.

SUMMARY OF THE INVENTION

The present invention solves many of the prior art misfeed problems associated with pneumatic separation of a top sheet of a stack of sheet material (such as a stack of paper, photos, transparencies and the like). It does this by first placing the vertical stack of sheet stock in a staircase configuration. In such a staircase configuration, the top sheet has been mechanically loosened from the sheet immediately under it by a staircasing action and placed in position to be moved forward by a stream of air delivered to the rear side of the top sheet. The second or next lower sheet in the stack, and all of the sheets below it, are held down by a holding force delivered to the top rear side of the second sheet in the stack by a hold down device. Thus the second uppermost sheet in the stack, and all of the sheets under it, are held in place in the face of the air stream that is aimed at the rear side of the top sheet in the stack. Aside from impinging on the rear side of the top sheet in the stack, this air stream also forces its way under said top sheet and, in effect, creates a moving air cushion between the underside of the top sheet and the top side of the second sheet (that is being held down by the sheet hold down device).

Consequently, the air stream pries the top sheet from the stack (without disturbing the other sheets in the staircased stack) and then conveys said top sheet in a forward direction toward a work station. This stream of air carries the top sheet into a sheet acquisition tunnel which defines a space in which the air stream, and the sheet of paper it carries, are confined and which leads to (or at least toward) a downstream work station. The work station is provided with a stop upon which the leading edge of the sheet being conveyed by the air stream impinges. This impingement causes the sheet to drop, under the influence of gravity (or by mechanical means such as downwardly directed air streams), to a defined working position at a work station. To aid in this dropping action, the cushioning air stream may be momentarily stopped and/or diverted to another path by air flow control valves or air stream diverting surfaces. The sheet is then operated upon at the work station. For example, in the case of a sheet of paper, the underside of the sheet of paper can be "read from" or "written to" in ways well known to the paper scanning, photocopying and printing arts. At the end of such operations (reading and/or writing), the sheet is lifted from the work station by blasts of air delivered to the underside and/or edge regions of said sheet. Upon being lifted to an elevation sufficient to clear the top of the work station, the sheet is again placed in an air stream which carries it to its next destination in a sheet handling path to be followed by that sheet. In some of the more preferred embodiments of this invention, the air stream that carries the sheet from the work station emanates from the same nozzle that originally pried the sheet from the staircased stack and delivered it to the work station.

The next destination in the sheet handling path can be a final destination wherein the sheet is delivered to a tray where it is vertically stacked upon previously delivered sheets. In the alternative the sheet can be delivered to another work station in the sheet handling path. In some of the more preferred embodiments of this invention, the air stream employed to (1) pry a top sheet from a stack, (2) convey that top sheet to a work station, (3) carry that sheet away from the work station and (4) deposits that sheet at some intermediate point or end point in the sheet handling process can, each, be aided by various air flow conveying tunnels, auxiliary air nozzles, sheet guide rails and sheet stopping devices hereinafter more fully described.

DETAILED DESCRIPTION OF THE INVENTION

Figure 1:
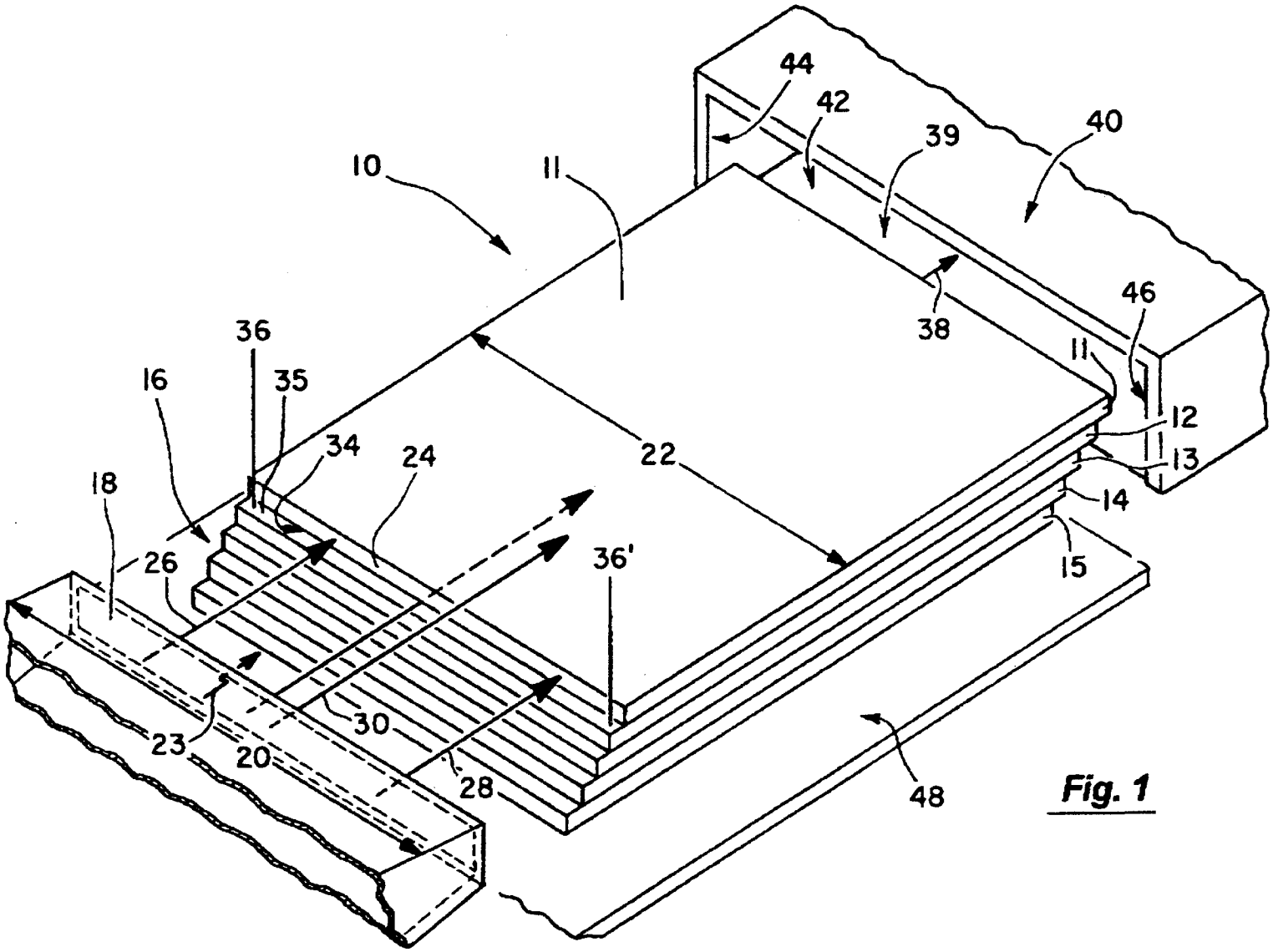
FIG. 1 is a perspective view of a stack of sheet stock (such as paper) in a staircase-like stacked arrangement.

FIG. 1 depicts a stack 10 of sheet stock material such as paper, photos, transparencies and the like. For purposes of illustration only, this stack 10 is shown to be comprised of five individual sheets 11, 12, 13,14 and 15. These five sheets are shown stacked in a staircase configuration. The rear side (left side) 16 of this staircased stack 10 is shown positioned in the vicinity of a nozzle 18. The nozzle 18 is shown having a width 20 which is substantially the same as the width of the stacked sheets, e.g., the width 22 sheet 11. By way of example only, sheet 11 could be a sheet of 8½×11 paper. Be the nature of the sheet stock as it may, the nozzle 18 is shown delivering a generalized stream of air 23 to the rear side of the top sheet 11 of stack 10. This generalized stream of air 23 also may be thought of as having several components. To this end, air stream component 26 and air stream component 28 are shown impinging upon the rear side 24 of the top sheet 11. Air stream component 30 is shown passing over the top of the top sheet 11. Air stream component 32 is shown passing under the top sheet 11. In other words, air stream 32 component can be thought of as having wedged itself between the interface 34 of the bottom of the top sheet 11 and the top of the next uppermost sheet 12. Air stream 32 also can be thought of as creating a laterally moving "cushion" of air upon which sheet 11 is conveyed away from the remainder of the stack 10.

FIG. 1 also shows the rear 35 of sheet 12 to be under the influence of a first downward force 36 on its left side and a second downward force 36' on its right side. These downward forces 36 and 36' serve to hold sheet 12 in place against the lateral force of the generalized air stream 23 directed against the rear side 24 of top sheet 11 by the nozzle 18. Moreover, these downward forces 36 and 36' serve to maintain the remaining sheets 13, 14 and 15 in place against the lateral force of the air stream 23 delivered by nozzle 18. In short, sheets 12, 13, 14, and 15 are held down while sheet 11 is free to move in a forward (i.e., rightward) direction generally indicated by direction arrow 38. The air stream 23 delivered by nozzle 18 then directs the top sheet 11 into a tunnel-like structure 39 that leads toward a work station (not shown in FIG. 1). Generally speaking, this tunnel-like structure 39 has a top surface 40, a bottom surface 42, a left side 44 and a right side 46. Thus, because of its function and structure applicant may occasionally refer to this structure (and others like it used in the practice of this invention) as a "wind tunnel". Thus, wind tunnel 39 receives the generalized air stream 23 delivered by the nozzle 18 and thereby acquires the sheet 11 carried by said air stream 23. Again, the opposite end (not shown) of this wind tunnel 39 will lead directly (or indirectly) to a work station (also not shown).

Figure 2:
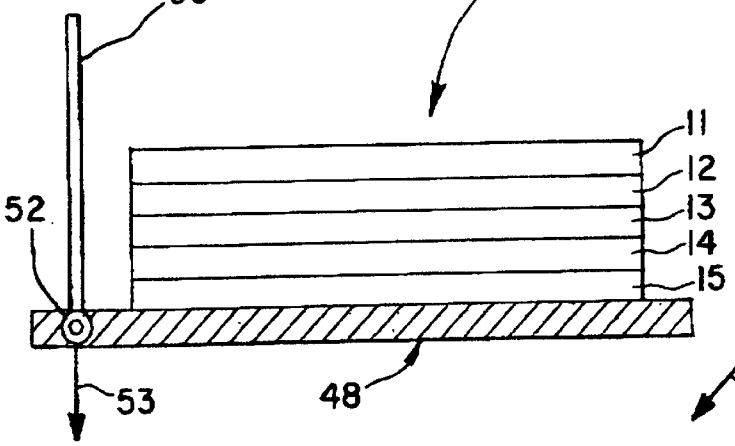
FIG. 2 is a side view of a vertically stacked array of sheet stock (e.g., sheets of paper).

FIG. 2 shows a generalized, stack 10 of sheet material comprised of individual sheets 11–15 in a vertically stacked array. To this end the left or rear side of the stack 10 may be registered against a vertical surface such as bar 50 or a vertical edge of a tray that holds the stack of sheets. This stack 10 of sheet material also is shown containing five vertically stacked sheets for purposes of illustration only. Thus, if this stack 10 were a stack of freshly opened and stacked xerographic paper, it would comprise five hundred sheets of 20 lb. (75 g/m$^2$) 8½×11 (216×279 mm) paper which would be about two inches high. Be the nature and number of sheets in the stack 10 as they may, FIG. 2 is intended to greatly exaggerate the thickness of the five individual sheets 11–15 of paper and greatly understate their length.

The stack 10 of sheets shown in FIG. 2 is generally depicted as resting upon a bottom or table-like surface 48. This bottom surface could, for example, be the bottom of a paper holding tray (otherwise not shown). This tray also could be provided with side walls (not shown) that serve to more exactly position the stack 10 in the tray. A powered side piece 50 is shown in a substantially vertical position to the left of the vertically aligned stack 10 shown in FIG. 2,. This powered side piece 50 is shown pivotally mounted (e.g., to the base 48) by means of a generalized pivot mechanism 52. The side piece 50 could be in the physical form of one or more bars. It also could be in the form of a plate that extends across a substantial part of the rear of the stack 10. For example, in the case of a stack of 8½×11 paper, the powered piece 50 could be about 8½ inches wide if it is to address the 8½ inch width of such paper. If this powered side piece 50 were in the form of a plate, it would have to have a cut out region that allows the air stream delivered by nozzle 18 to impinge on sheet 11. In the alternative, the powered side piece 50 could be lowered out of the path of the air stream 23 delivered by the nozzle 18 after said side piece 50 has performed its staircasing function.

Figure 3:
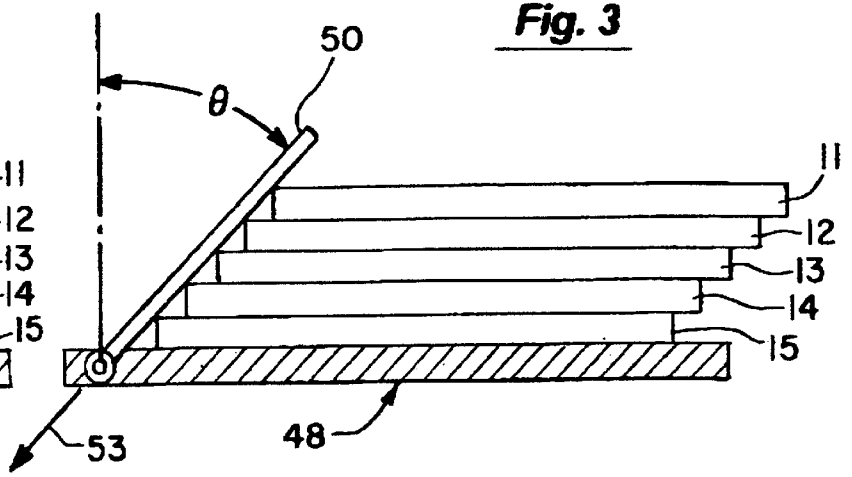
FIG. 3 is a side view of a stack of sheet stock in a staircase-like arrangement such as that shown in FIG. 1.

FIG. 3 shows the powered side piece 50 having been power rotated from the vertical orientation shown in FIG. 2 to the angle theta shown in FIG. 3. As part of this powered rotation, the side piece 50 is driven against the left side of the vertical stack 10 shown in FIG. 2. This powered rotation of side piece 50 about a pivot point mechanism 52 forces the stacked array of sheets 11–15 into a step-like, or stair-like, configuration such as that shown in FIG. 3. This step-like configuration is substantially the same as that shown in FIG. 1. In other words, the staircase arrangement shown in FIG. 1 can be assumed to have been produced by a powered rotation of side piece 50. Having performed this staircasing function, the powered side piece 50 can be returned to its original vertical position (i.e., as shown in FIG. 2) or it can be lowered out of the way of the air stream 23 in the manner generally suggested by downwardly directed arrow 53.

Figure 4:
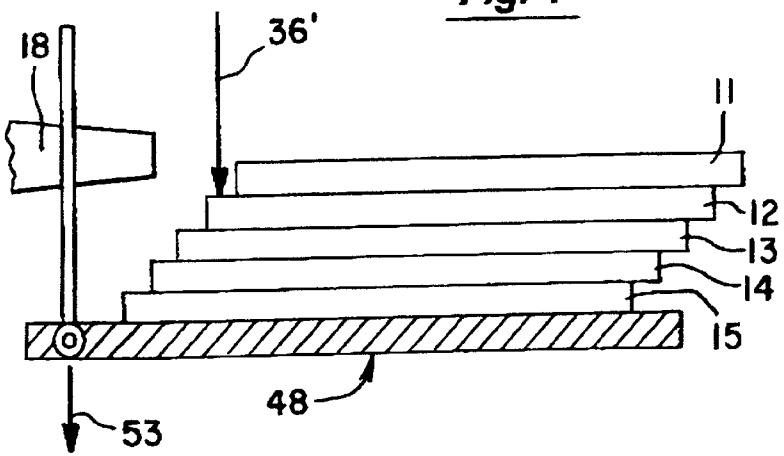
FIG. 4 is a side view of a staircase stacked array of sheet stock whose second or next topmost sheet is held down by a downwardly directed mechanical force.

FIG. 4 shows a downwardly directed force 36' that can be supplied by a pointed arrow-like or (pin-like) element such as that shown as arrow 36' in FIG. 4. Such a force also could be delivered by a foot-like element or by a nip roller-like element that could respectively press against the upper left side 35 of sheet 12. Hence, regardless of the shape of the hold down device, the remaining sheets (13–15) under sheet 12 are pressed downward toward the base plate 48. Hence, sheets 13–15 are held in place in the face of the air stream 23 delivered by nozzle 18. Again, in order to do this, the nozzle 18 must protrude through an opening in plate-like powered side piece 50, or said side piece 50 can be lowered in the manner generally suggested by downwardly directed arrow 53.

Figure 5:
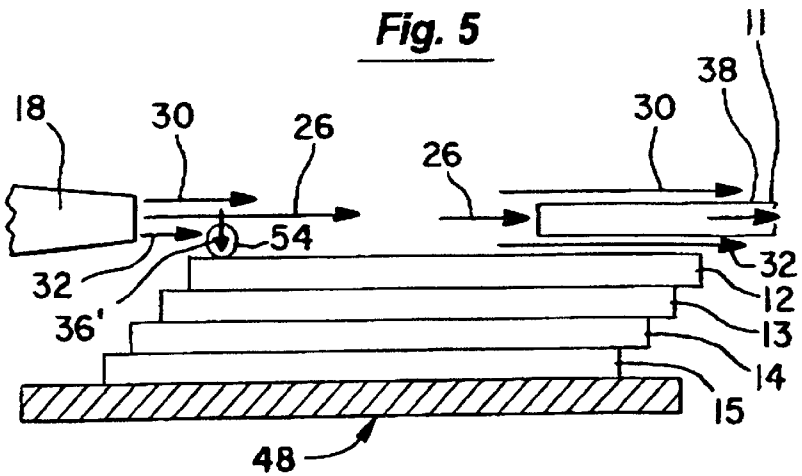
FIG. 5 is a side view of a staircase stacked array of sheet stock from which the top sheet is shown being carried away by a stream of air delivered by a nozzle.

FIG. 5 shows top sheet 11 being removed from the remainder of the stack (sheets 12–15). In effect, the top sheet 11 is driven in a forward direction 38 by various components of the air stream 23 delivered by nozzle 18. For example, that component of the air stream delivered by nozzle 18 that impinges on the rear side of sheet 11 is given item number 26 in FIG. 5, as it was in FIG. 1. Similarly, that element of the air stream 23 that passes over the top of sheet 11 is shown as item 30 while that portion of the air stream 23 which passes under sheet 11 is depicted by item number 32 as it was in FIG. 1. In effect, the air stream portion depicted by item 32 has wedged the bottom of sheet 11 out of contact with the top of sheet 12 and has created an air cushion upon which sheet 11 is conveyed. Here again the other sheets in the stack (sheets 12–15) are shown held in place by a downward directed force 36' (as well as the downward directed force 36 shown in FIG. 1). This downwardly directed force also could be created by a so-called nip wheel such as the nip wheel 54 shown in FIG. 5. This downward force 36' also may be created by a pin-like element (such as that suggested in FIG. 4), or by a foot-like element (such as that shown in FIG. 6).

Figure 6:
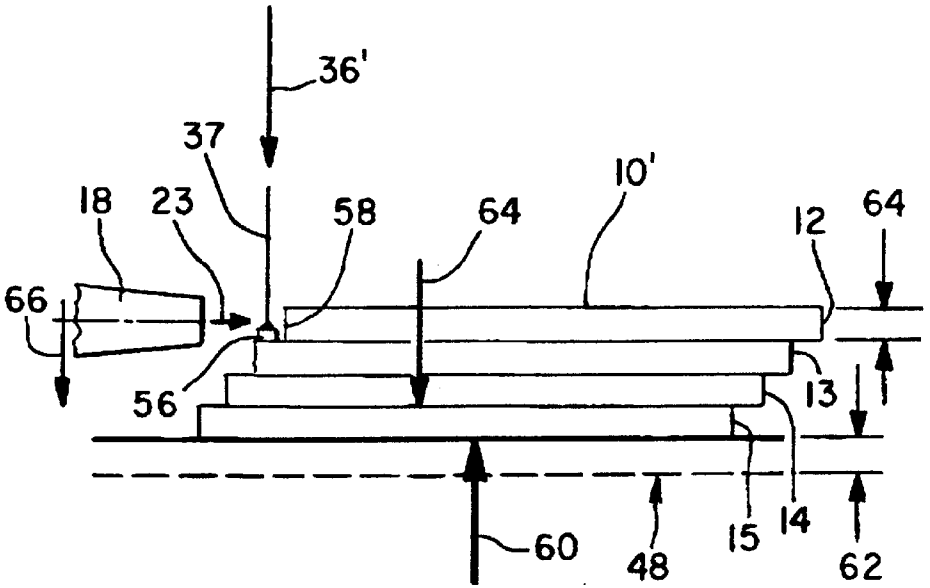
FIG. 6 is a side view of a staircase stacked array of sheet stock being lifted to a higher elevation in order to align the next sheet in the stack with the nozzle.

To this end, FIG. 6 shows a foot-like element 37 pressing downward on the top of sheet 13 under the influence of a downwardly directed force 36' . Again, this arrangement is shown by way of contrast with the nip wheel 54 shown providing a similar downward force 36' in FIG. 5 and/or by way of contrast with the arrow-like element and its down delivered force (depicted as item 36') in FIG. 4. In any case, FIG. 6 shows sheet 12 as now being the uppermost sheet in the stack 10'. That is to say that sheet 11 has been removed from the stack 10' so that sheet 12 is now the uppermost or topmost sheet in said stack. FIG. 6 also shows nozzle 18 in position to deliver a stream of air 23 against the rear side 58 of sheet 12. In order to more accurately deliver the air stream 23 to said rear edge 58 of sheet 12, the tray 48 can be occasionally raised. For example, FIG. 6 shows the tray 48 being lifted by a distance 62 substantially equal to the thickness 64 of the sheet material 12. This lifting action is shown by direction arrow 60. In other words arrow 60 suggests that tray 48 be lifted a distance 62 which is comparable to the thickness 64 of the last sheet (e.g., sheet 11) removed from the stack 10'. This lifting action could occur after every, every second, every third, every fourth, etc. sheet has been removed from the stack. In the alternative, the nozzle 18 could be lowered at comparable intervals by comparable distances (e.g., distance 62) as generally indicated by direction arrow 66.

Figure 7:
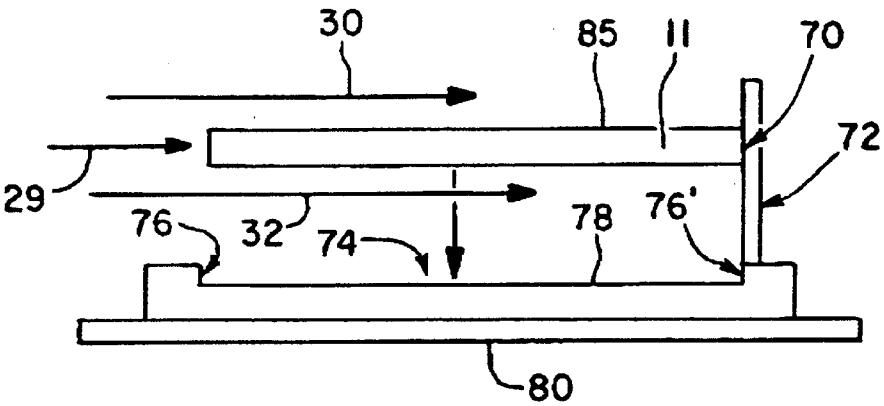
FIG. 7 is a side view of a sheet being carried in a stream of air and impinging upon a sheet stop element positioned above a work station.

FIG. 7 shows sheet 11 being carried along a generalized sheet handling path 29 by various components 32, 26, 30 of air stream 23 until the leading edge 68 of sheet 11 impinges upon a side 70 of a stop bar 72. A tray-like work station 74 is shown positioned below sheet 11. As previously noted, the sheet feeding apparatus of this patent disclosure may further comprise one or more time delay circuits (not shown) for establishing a preselected time delay between the passage of an edge (e.g., a trailing edge) of a sheet and the switching of air valves delivering air streams to various nozzle(s) used in this apparatus. Similarly, the apparatus may further comprise means for delaying the actuation of said valves in response to signals from time delay circuits which are, in turn, connected to a sensor for sensing a moving sheet (e.g., sensing its leading edge or trailing edge). These control action methods and devices are all well known to those skilled in this art.

The cutaway side view of FIG. 7 generally shows the tray-like work station 74 having side members 76 and 76' and a bottom surface member 78. The side members serve to accurately position the sheet 11 in the work station 74. The bottom surface member 78 of work station 74 should be made of a clear material such as glass or plastic that is capable of passing electromagnetic energy such as light. The bottom surface member 78 may reside upon a generalized mechanical support 80 which is part of a electromagnetic energy employing device such as a scanner, facsimile machine, photocopier, printer and the like. That is to say that the support 80 holds the window of glass, plastic, etc. that constitutes the bottom surface member 78 through which electromagnetic energy passes as a part of the process (e.g., reading, writing) carried out at work station 74.

Figure 8:
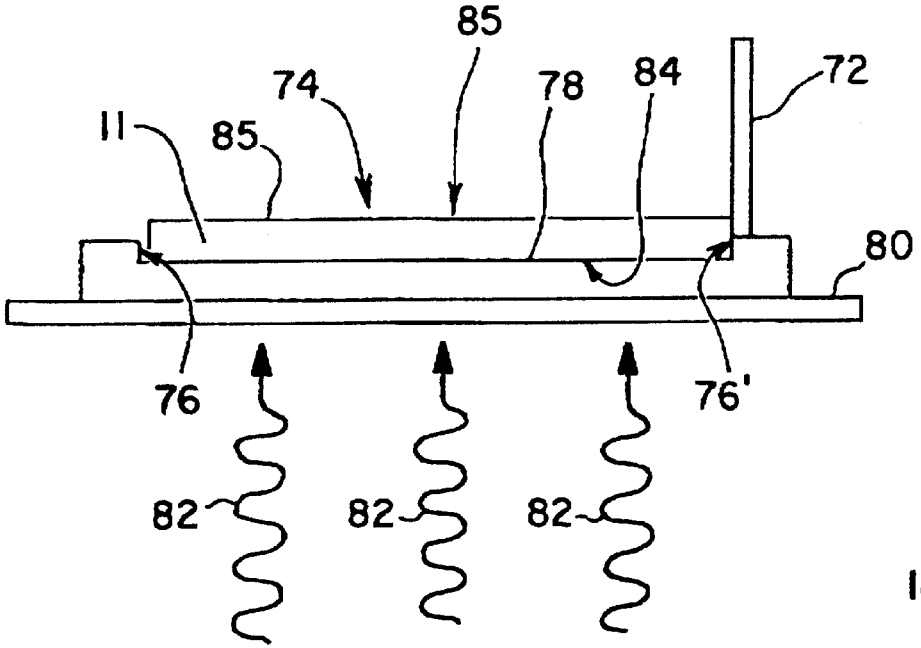
FIG. 8 is a side view of the sheet depicted in FIG. 7 positioned in a work station.

FIG. 8 depicts a sheet of paper 11 residing in the tray-like work station 74 shown in FIG. 7. Again, the bottom surface of said work station is able to pass electromagnetic energy such as the highly generalized electromagnetic energy 82 shown emanating from a region under the bottom of the window-like bottom surface 78. Such electromagnetic energy penetrates said bottom surface member 78 and impinges upon the bottom side 84 of sheet 11 and thereby reads information (e.g., "scans" the information) written upon the bottom side 84 of sheet 11, or imparts information to (writes upon) said bottom side 84 in ways well known to the scanning, photocopying and printing arts. Again, an exemplary work station would be a scanner screen which "reads" printing appearing on the bottom side 84 of sheet 11 and then electronically processes the information taken from said sheet. The work station could also perform such operations with respect to the top side 85 of sheet 11.

Figure 9:
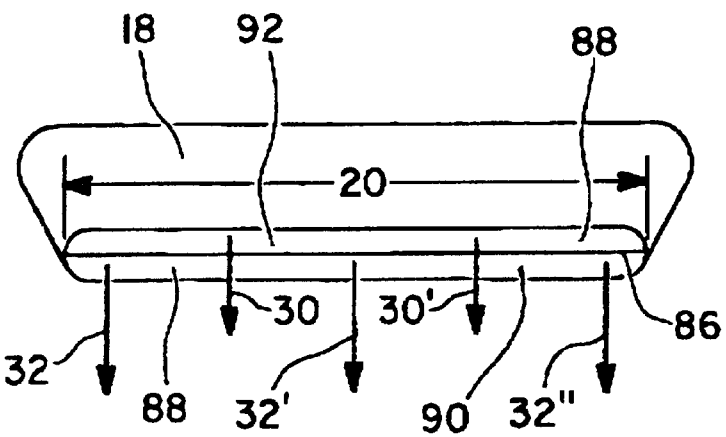
FIG. 9 is a perspective view of a nozzle for delivering the stream of air upon which the individual sheets are conveyed.

FIG. 9 depicts a perspective view of the nozzle 18 shown in FIG. 1. Preferably the nozzle 18 will have a width 20 that approximates the width of the sheet to be carried by the air stream 23. The nozzle 18 in FIG. 9 is shown having a partition 86 across its nozzle mouth 88. Thus, the partitioned nozzle 18 can have an air stream component that is stronger in some regions than in other regions. For example arrows 32, 32' and 32" are shown coming out of the nozzle 18 a greater distance than arrows 30 and 30'. This is to imply that the portion of the generalized streams of air 32, 32', 32" emanating from the bottom half 90 of the partitioned nozzle 18 may be stronger than the streams of air 30, 30' emanating from the top half 92 of the partitioned nozzle 18. For the same reason, FIG. 7 depicted arrow 32 extending a greater distance to the right than arrow 30 in order to signify that the force of air stream 32 may be greater than that of air stream 30. Again, such an air stream arrangement serves to create a "cushion" of air on the underside 84 of sheet 11. Those skilled in this art also will appreciate that nozzle 18 could be replaced by an array of smaller nozzles that emit air streams having different forces.

Figure 10:
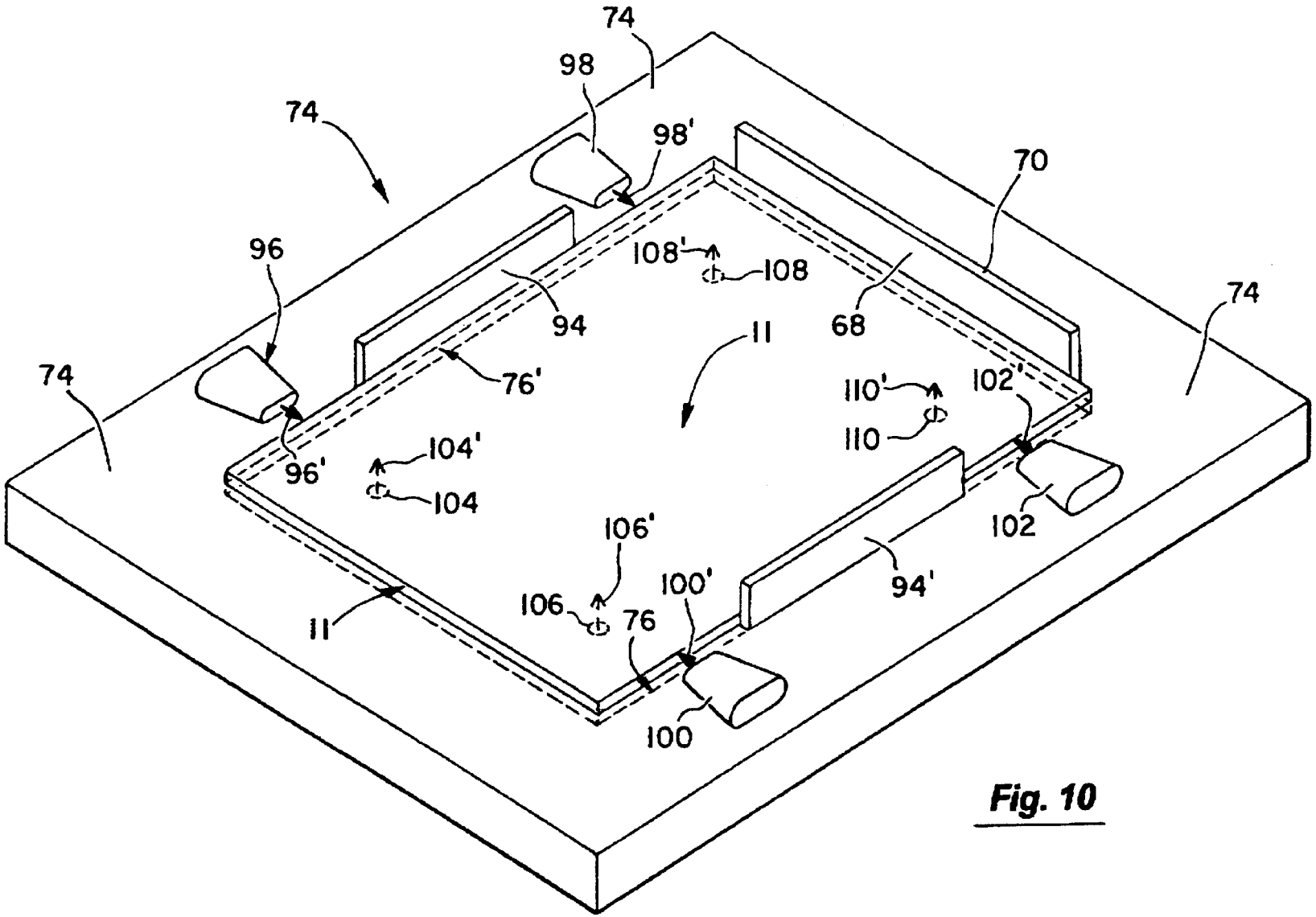
FIG. 10 is a top perspective view of a work station (such as the one depicted in FIG. 8) to which a sheet has been delivered.

FIG. 10 shows a perspective view of the tray-like work station 74 shown in FIGS. 7 and 8. A sheet of paper 11 is shown residing in the tray 74. Air jet portholes 104, 106, 108 and 110 are depicted as being positioned under the sheet 11. These air jet portholes respectively supply air jet streams 104', 106', 108' and 110'. These air jet streams serve to lift sheet 11 out of the tray 74 in the manner generally suggested in FIG. 11. FIG. 10 also shows an array of air jet nozzles 96, 98, 100, and 102 which are laterally located around the perimeter of sheet 11. These jet nozzles respectively supply lateral air streams 96', 98', 100' and 102' to the side edge regions (lateral to the direction of air stream 23) of the sheet 11 in order to lift said sheet 11 from the tray 74. Such air jet nozzles (96–102) can be employed in addition to, or in place of, the previously noted air jets 104', 106', 108', and 110'. The operation of these air jet nozzles (96 and 100) also is further depicted in the side view shown in FIG. 12. FIG. 10 also shows two side guide bars 94 and 94' for guiding the sheet into and out of the work station 74. Similar guide bars can be used to direct air streams and/or the sheets of paper that said air streams carry.

Figures 11, 12, 13, 14:
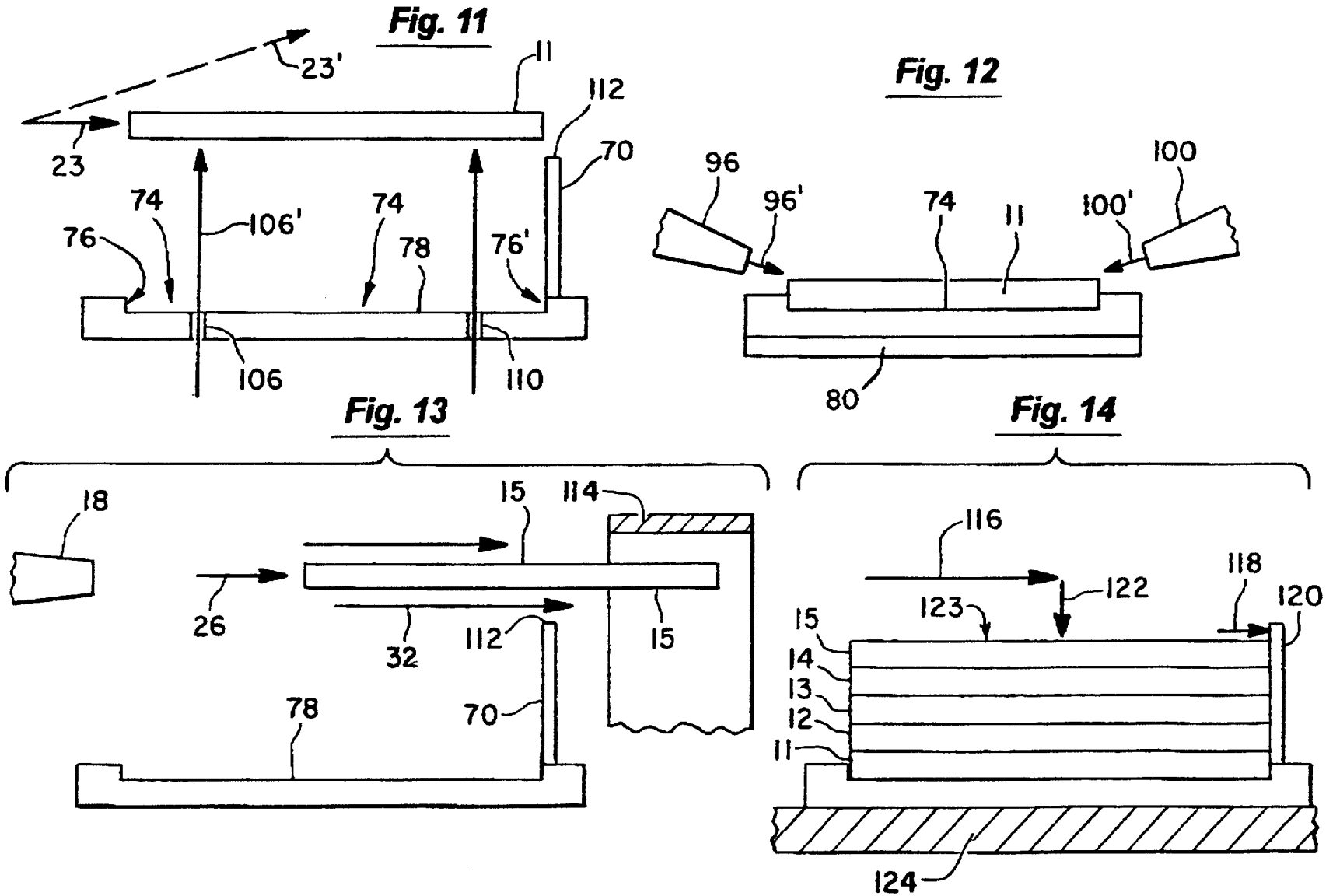
FIG. 11 is a side view showing a sheet being withdrawn from a work station by air streams delivered to the bottom surface of the sheet.
FIG. 12 is a side view showing air jets positioned to remove a sheet from a work station.
FIG. 13 is a side view depicting a sheet being conveyed by an air stream past a work station and into a second air tunnel.
FIG. 14 is a side view that depicts a stack of sheet material in a vertically stacked array.

FIG. 11 shows sheet 11 being lifted to an elevated position above the tray 74 (and above stop bar 72) by upwardly directed air streams 106' and 110'. These two air streams are respectively delivered through air ports 106 and 110 in the bottom surface 78 of work station 74. These upwardly directed air jets could be replaced by (or aided by) one or more vacuum-producing devices (not shown) suitably positioned above sheet 11. In any case, the elevation to which sheet 11 is lifted should be sufficient for said sheet 11 to clear the top 112 of the stop bar 70. FIG. 11 also shows how air stream 23 may be used to deliver sheet 11 to the work station 74 and how said air stream may be diverted to air stream path 23' in order to allow the sheet 11 shown in FIG. 7 to drop into the work station 74. The air stream 23 used to deliver sheet 11 also may be momentarily shut off (and/or diverted) just as the sheet impinges upon stop bar 72.

FIG. 12 shows air nozzle 96 delivering a stream of air 96' to the left side of sheet 11 and air nozzle 100 delivering a stream of air 100' to the right side of sheet 11. These downwardly directed streams of air can be used to lift the sheet 11 from the tray-like work station 74. Air streams 96' and 100', delivered in this manner, can force these streams under sheet 11 and thereby pry it from the bottom surface 78 of work station 74. These air streams can likewise be used in conjunction with various sensing means and electrical circuits that operate air shut off valves in ways known to those skilled in this art.

FIG. 13 shows a sheet 15 being lifted to an elevation above the tray that is sufficient for sheet 15 to clear the top edge 112 of the stop bar 72. FIG. 13 also depicts sheet 15 being delivered into a second tunnel device 114. Air streams 30, 26 and 32 carry sheet 15 through the second tunnel device 114 much in the way that sheet 11 was carried through tunnel 39 in FIG. 1. These air streams may be produced by nozzles not shown herein. In some of the preferred embodiments of this invention, however, the same nozzle 18 that provided the air stream 23 that delivered sheet 15 to the work station 74 can be employed to deliver a stream of air to carry sheet 15 away from the work station 74 after sheet 15 has been processed (e.g., read from or written upon). Here again, air stream 23 could be, but need not be, interrupted by momentarily shutting it off, or by directing it in another direction such as the oblique direction 23' shown in FIG. 11.

FIG. 14 shows a part of a sheet handling path 116 that eventually impinges at point 118 on a second stop bar 120. Upon colliding with this second stop bar 120, a sheet of paper (e.g., sheet 15) will drop downward (in the direction depicted by arrow 122) onto a stack 123 of sheet stock resting on a surface 124 such as a paper receiving tray. These sheets are shown vertically stacked in FIG. 14. The sheets are, however, stacked in the order they were delivered to tray 124. That is to say sheet 11 is now on the bottom of this stack 123 and sheet 15 is on the top.

Figure 15:
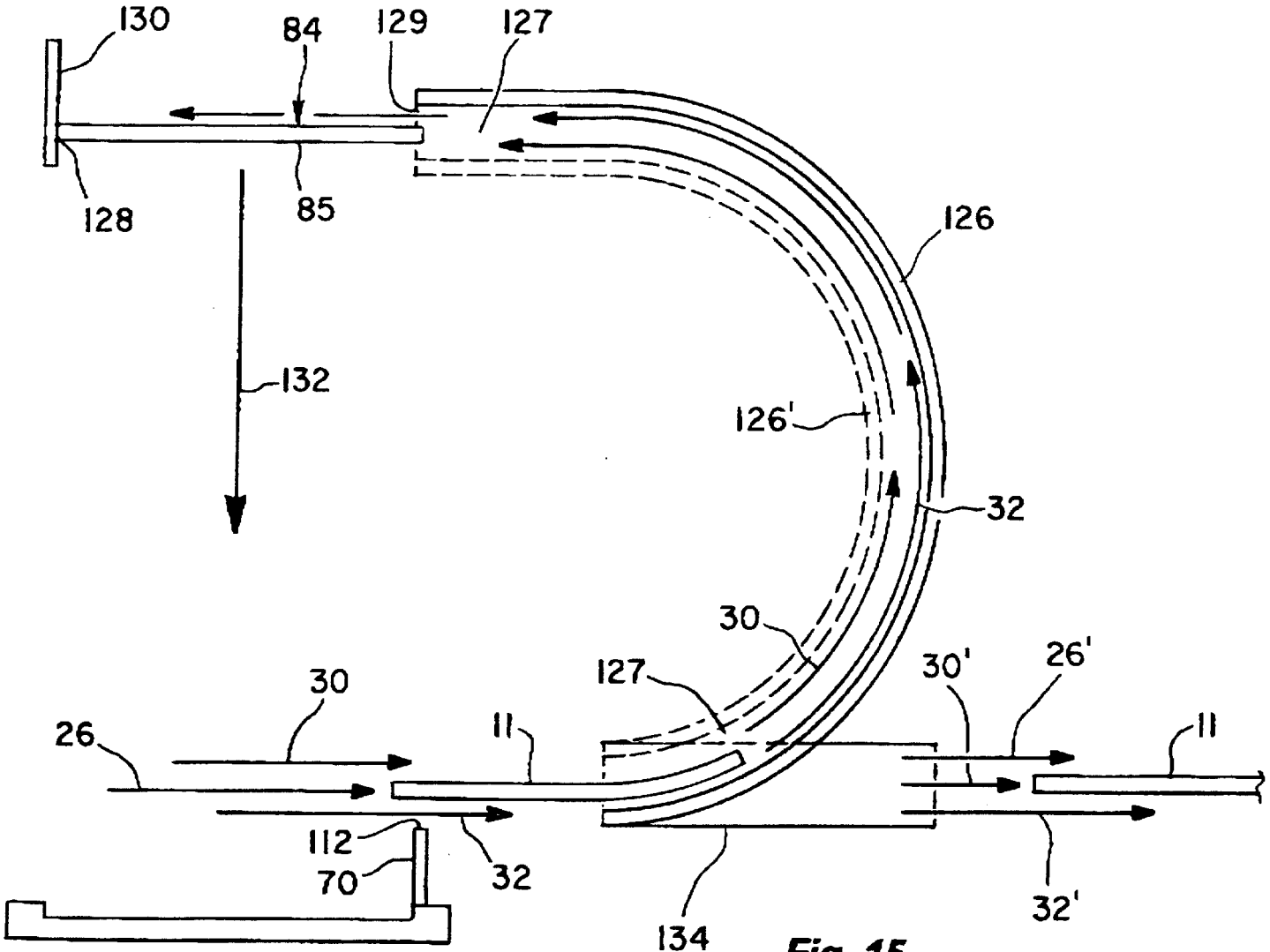
FIG. 15 is a partial cut-away side view of a sheet being turned over through use of a curved surface or curved tunnel.

FIG. 15 depicts an alternative embodiment of this invention wherein a sheet of paper 11 (being conveyed on air streams 32, 26 and 30) is directed against a curved surface 126. This curved surface 126 is shown as a solid line. A curved line 126' is shown in dotted lines to depict the fact that the two curves 126 and 126' may be part of a curved wind tunnel 127 through which the paper 11 is carried by an air stream. This air stream may be augmented by air streams introduced at the sides of this curved tunnel. As the paper leaves the upper end 129 of the curved surface 126 (or curved wind tunnel 126–126'), it travels to a point 128 where it impinges upon a third stop bar 130 whereupon said sheet 11 again drops downward (in the direction depicted by arrow 132) and is stacked or otherwise handled. In any case, sheet 11 has been turned over by the action delivered by curved surface 126 or curved tunnel (126–126'). Therefore sheet 11 is ready for operations on its top side 85 (now on the downward facing surface of said sheet 11). That is to say that the former bottom side 84 is now the top side of sheet 11. Hence, the former top side 85 can now be read from or written upon in work station 74 or some other work station (not shown). After both sides of sheet 11 have been read (or written upon), the sheet is dispensed from the apparatus. This can be done in various ways. For example, the sheet 11 can be reintroduced into air streams 26, 30 and 32 and fed into a sheet dispensing mechanism 134. As indicated in FIG. 15, sheet 11 is conveyed by air streams 26', 30' and 32' to a stacking tray outside of the apparatus (not shown). To this end, the sheet dispensing mechanism 134 can be provided with a gate mechanism (not shown) that either sends a sheet through the curved wind tunnel 127 or through the sheet dispensing mechanism 134 in accordance with programmed instructions.

The foregoing description of the present invention has been presented for purposes of illustration and description only. It is not intended to be exhaustive or to limit the invention to the precise forms disclosed herein. Other modifications and variations may be possible in light of the foregoing teachings. For example, a paper handling embodiment was chosen and described in order to best explain the principles of the invention and its practical application and thereby enable others skilled in the art to best utilize the invention in various other embodiments and modifications wherein sheet stock other than paper could be handled. Thus, the appended claims can be construed to include other alternative embodiments of the invention not otherwise limited by the prior art.

I claim:

1. A sheet feeding apparatus for removing individual sheets from a stack and conveying them to a work station, said apparatus comprising:

(1) a tray for holding a stack of sheets in a vertical array;

(2) a powered pivot device for forcing the stack of sheets into a staircased configuration;

(3) a hold down device for holding down those sheets in the stack located below a top sheet in said stack; and (4) a nozzle for delivering an air stream to the rear of the top sheet in said stack and thereby prying it from the stack and conveying it to a work station.

2. The apparatus of claim 1 further comprising a tunnel into which the top sheet is delivered by the air stream used to pry the top sheet from the stack.

3. The apparatus of claim 1 further comprising a tray elevation adjustment device for positioning a second topmost sheet in the stack in front of the nozzle after the top sheet has been removed from said stack.

4. The apparatus of claim 1 further comprising a stop bar for impinging against a leading edge of a sheet being carried by the air stream and thereby serving to direct said sheet into the work station.

5. The apparatus of claim 1 further comprising a nozzle capable of delivering a stream of air having a bottom air stream component that is stronger than a top air stream component.

6. The apparatus of claim 1 further comprising a work station for receiving the sheet and performing read/write operations thereon.

7. The apparatus of claim 1 further comprising a work station having a bottom surface capable of passing electromagnetic energy to read information on a bottom side of a sheet delivered to said work station.

8. The apparatus of claim 1 further comprising a work station having a bottom surface capable of passing electromagnetic energy to write upon the bottom side of a sheet delivered to said work station.

9. The apparatus of claim 1 further comprising air jets for lifting the sheet from the work station.

10. The apparatus of claim 1 further comprising vacuum air jets for lifting the sheet from the work station.

11. The apparatus of claim 1 further comprising a nozzle for directing a stream of air to the rear side of a sheet lifted from the work station and conveying said sheet to another point in a sheet handling path.

12. The apparatus of claim 1 further comprising an air tunnel for directing an air stream delivered by the nozzle that delivered the sheet to the work station and conveying said sheet to another point in a sheet handling path.

13. The apparatus of claim 1 that employs an air stream delivered by the same nozzle that delivered the sheet to the work station in order to convey said sheet to a second air tunnel that leads to a second stack.

14. The apparatus of claim 1 that employs an air stream delivered by the same nozzle that delivered the sheet to the work station in order to convey said sheet to a sheet turnover device.

15. The apparatus of claim 1 further comprising a sheet turnover device that has a curved surface against which the leading edge of the paper impinges and follows the curved surface and thereby turning over the sheet.

16. The apparatus of claim 1 further comprising a sheet turnover device that has a curved tunnel for delivering the sheet to a stop bar against which the leading edge of the turned over sheet impinges and thereby causing the turned over sheet to drop to a lower position for subsequent handling operations.

17. The apparatus of claim 1 further comprising a time delay circuit for establishing a preselected time delay between the passage of an edge of a sheet and the switching of a valve that controls flow of air through a nozzle.

18. The apparatus of claim 1 further comprising a delay means for delaying the actuation of a valve with the passage of a trailing edge of a sheet past a sensor.

19. The apparatus of claim 1 further comprising a sheet dispensing mechanism.

20. The apparatus of claim 1 further comprising a sheet dispensing mechanism associated with a sheet turnover device in a manner such that a sheet is either turned over or dispensed from the apparatus.

* * * * *